US011052525B2

(12) United States Patent
Furusawa et al.

(10) Patent No.: US 11,052,525 B2
(45) Date of Patent: Jul. 6, 2021

(54) HAMMER DRILL

(71) Applicant: MAKITA CORPORATION, Anjo (JP)

(72) Inventors: Masanori Furusawa, Anjo (JP); Keita Mori, Anjo (JP); Yoshiro Tada, Anjo (JP)

(73) Assignee: MAKITA CORPORATION, Anjo (JP)

( * ) Notice: Subject to any disclaimer, the term of this patent is extended or adjusted under 35 U.S.C. 154(b) by 773 days.

(21) Appl. No.: 15/421,118

(22) Filed: Jan. 31, 2017

(65) Prior Publication Data

US 2017/0252915 A1 Sep. 7, 2017

(30) Foreign Application Priority Data

Mar. 3, 2016 (JP) ..... JP2016-041384
Mar. 3, 2016 (JP) ..... JP2016-041385

(51) Int. Cl.
*B25D 16/00* (2006.01)
*B25D 11/06* (2006.01)

(52) U.S. Cl.
CPC ..... *B25D 16/006* (2013.01); *B25D 11/062* (2013.01); *B25D 2211/003* (2013.01);
(Continued)

(58) Field of Classification Search
CPC .... B25D 11/062; B25D 11/06; B25D 16/006; B25D 16/003; B25D 16/00; B25D 2211/003; B25D 2211/061; B25D 2211/06
(Continued)

(56) References Cited

U.S. PATENT DOCUMENTS 4,895,212 A * 1/1990 Wache ..... B25D 16/003 173/109
5,901,817 A 5/1999 Gitnes
(Continued)

FOREIGN PATENT DOCUMENTS

CN 1502436 A 6/2004
JP S52-037057 A 3/1977
(Continued)

OTHER PUBLICATIONS

Oct. 28, 2019 Office Action issued in Japanese Patent Application No. 2016-041384.
(Continued)

*Primary Examiner* — Valentin Neacsu
(74) *Attorney, Agent, or Firm* — Oliff PLC

(57) ABSTRACT

A hammer drill includes a housing, a tool holder, a hammering member, a gear, and a conversion member. The gear is switched to a first state where a rotation of the intermediate shaft is transmitted and a second state where the rotation of the intermediate shaft is not transmitted, and a mode switching member is configured to perform a switching operation of the state of the gear from an outside of the housing. The switching of the state of the gear by the mode switching member provides at least two operation modes of a hammer drill mode where the gear integrally rotates with the intermediate shaft to generate the rotation and a reciprocation of the hammering member on the tool holder and a hammer mode where the gear is separated from the rotation of the intermediate shaft to generate only the reciprocation of the hammering member.

20 Claims, 9 Drawing Sheets

(52) U.S. Cl.
CPC ..... *B25D 2211/061* (2013.01); *B25D 2216/0015* (2013.01); *B25D 2216/0023* (2013.01); *B25D 2216/0038* (2013.01); *B25D 2216/0084* (2013.01)

(58) Field of Classification Search
USPC ..... 173/48
See application file for complete search history.

(56) References Cited

U.S. PATENT DOCUMENTS

| | | | | |
|---|---|---|---|---|
| 6,035,945 | A * | 3/2000 | Ichijyou | B25D 11/062 173/109 |
| 6,971,455 | B2 | 12/2005 | Shibata et al. | |
| 7,748,472 | B2 * | 7/2010 | Yoshikane | B25D 16/006 173/102 |
| 2004/0108123 | A1 * | 6/2004 | Shibata | B25D 16/00 173/201 |
| 2011/0088922 | A1 * | 4/2011 | Hirayama | B25F 5/02 173/90 |
| 2013/0000937 | A1 * | 1/2013 | Onoda | B25D 11/062 173/122 |
| 2015/0144366 | A1 * | 5/2015 | Machida | B25F 5/006 173/104 |
| 2015/0328760 | A1 * | 11/2015 | Ikuta | B25D 11/00 173/117 |
| 2015/0328764 | A1 * | 11/2015 | Yoshikane | B25F 5/02 173/104 |
| 2016/0136801 | A1 * | 5/2016 | Furusawa | B25F 5/026 173/162.2 |
| 2016/0151904 | A1 * | 6/2016 | Ookubo | B25D 16/00 173/109 |
| 2016/0151905 | A1 * | 6/2016 | Tada | B25D 17/24 173/210 |
| 2016/0339577 | A1 * | 11/2016 | Takeuchi | B25D 17/24 |

FOREIGN PATENT DOCUMENTS

| | | | | |
|---|---|---|---|---|
| JP | H09-272005 | A | | 10/1997 |
| JP | H11-101274 | A | | 4/1999 |
| JP | 2004-167638 | A | | 6/2004 |
| JP | 2006-181664 | A | | 7/2006 |
| JP | 2006341339 | A | * | 12/2006 |
| JP | 2007-187247 | A | | 7/2007 |
| JP | 4746920 | B2 | * | 8/2011 |
| JP | 4746920 | B2 | | 8/2011 |
| JP | 2016-022567 | A | | 2/2016 |
| WO | 2014/156471 | A1 | | 10/2014 |

OTHER PUBLICATIONS

Oct. 25, 2019 Office Action issued in Japanese Patent Application No. 2016-041385.
Sep. 3, 2020 Office Action issued in Chinese Patent Application No. 201710118002.4.
Apr. 21, 2021 Office Action issued in Chinese Patent Application No. 201710118002.4.

* cited by examiner

HAMMER DRILL

BACKGROUND

This application claims the benefit of Japanese Patent Application Numbers 2016-041384 and 2016-041385 both filed on Mar. 3, 2016, the entirety of which is incorporated by reference.

TECHNICAL FIELD

The disclosure relates to a hammer drill configured such that a tool holder to hold a tool bit is disposed on a housing so as to be movable back and forth and to be projectingly biased forward, and operation modes are selectable depending on a front or rear position of the tool holder.

RELATED ART

As disclosed in Japanese Patent No. 4746920, there has been known a hammer drill such that a tool holder to hold a tool bit such as a drill bit is disposed in a housing so as to be movable back and forth and to be projectingly biased forward. The housing includes an intermediate shaft, to which a rotation of a motor is transmitted, parallel to the tool holder. The intermediate shaft includes a gear configured to transmit the rotation to the tool holder, a conversion member configured to convert the rotation of the intermediate shaft to a reciprocation of a hammering member such as a piston cylinder housed in the tool holder, and a clutch configured to engage with/disengage from the conversion member in association with a back-and-forth movement of the tool holder. In this hammer drill, the operation of the mode switching member allows the operation mode to be selected such that a drill mode is selectable when the tool holder is restricted to retreat on a position where the clutch does not engage with the conversion member while a hammer drill mode is selectable when the tool holder is allowed to retreat to a position where the clutch engages with the conversion member.

Such a small-sized hammer drill includes only the drill mode and the hammer drill mode as the selectable operation mode because of the constant meshing state of the gear disposed on the intermediate shaft with a gear disposed in the tool holder. Thus, it has been required to have usability as a large-sized hammer drill configured to select a hammer mode.

Therefore, it is an object of the disclosure to provide a hammer drill with improved usability even if the hammer drill is configured to select the operation mode depending on the front or rear position of the tool holder projectingly biased forward.

SUMMARY

In order to achieve the above-described object, there is provided a hammer drill according to a first aspect of the disclosure includes a housing, a tool holder, a hammering member, an intermediate shaft, a gear, and a conversion member. The housing is configured to house a motor. The tool holder is configured to hold a tool bit. The tool holder is disposed in the housing so as to be movable back and forth and projects biased forward. The hammering member is disposed movable back and forth inside the tool holder. The intermediate shaft is disposed parallel to the tool holder inside the housing. A rotation of the motor is transmitted to the intermediate shaft. The gear is disposed on the intermediate shaft. The gear transmits the rotation of the intermediate shaft to the tool holder. The conversion member is disposed on the intermediate shaft. The conversion member converts the rotation of the intermediate shaft to a reciprocation of the hammering member.

The gear may be configured to be switched to a first state where the rotation of the intermediate shaft is transmitted and a second state where the rotation of the intermediate shaft is not transmitted. A mode switching member may be configured to perform a switching operation of the state of the gear from an outside of the housing. The switching of the state of the gear by the mode switching member may provide at least two operation modes of a hammer drill mode and a hammer mode. The hammer drill mode is a mode where the gear integrally rotates with the intermediate shaft to generate the rotation and a reciprocation of the hammering member on the tool holder. The hammer mode is a mode where the gear is separated from the rotation of the intermediate shaft to generate only the reciprocation of the hammering member.

In the hammer drill according to a second aspect of the disclosure, preferably, the gear may be configured to slide between an engaging position where the gear engages with the intermediate shaft to integrally rotate and a non-engaging position where the engagement with the intermediate shaft is released so as to switch to the first state and the second state. The mode switching member may perform the switching operation of the slide position of the gear from the outside of the housing.

In the hammer drill according to a third aspect of the disclosure, preferably, the hammer drill further may include a clutch disposed on the intermediate shaft integrally rotatable and slidable in an axial direction and configured to move back and forth in association with the back-and-forth movement of the tool holder so as to engage with and disengage from the conversion member.

The mode switching member may be configured to switch the slide position of the clutch to a meshing position where the clutch meshes with the conversion member to integrally rotate and a non-meshing position where the meshing with the conversion member is released. Switching between the engaging position of the gear and the non-meshing position of the clutch may provide a drill mode where the gear integrally rotates with the intermediate shaft to generate only the rotation on the tool holder to be additionally selectable.

In the hammer drill according to a fourth aspect of the disclosure, preferably, on the non-engaging position of the gear, rotation restricting means may be disposed to restrict the rotation of the gear.

In the hammer drill according to a fifth aspect of the disclosure, preferably, the rotation restricting means may include a support pin disposed upright from an inner surface of the housing parallel to the intermediate shaft, a locking member penetrated and supported by the support pin to mesh with the gear on the non-engaging position, and a coil spring that biases the locking member to the meshing position with the gear.

In the hammer drill according to a sixth aspect of the disclosure, preferably, the housing internally may include a guide shaft supported parallel to the intermediate shaft, a sliding member configured to lock on the gear to move back and forth along the guide shaft, and a biasing means that biases the sliding member to the engaging position of the gear. The sliding member may move in an opposite direction to the biasing direction of the biasing means in accordance with the switching operation of the mode switching member, such that the gear slides to the non-engaging position.

In the hammer drill according to a seventh aspect of the disclosure, preferably, the sliding member may be disposed on a side of the intermediate shaft.

In the hammer drill according to an eighth aspect of the disclosure, preferably, the housing may internally include an inner housing configured to support a rear end of the intermediate shaft. The inner housing may include a stopper portion with which the sliding member is brought in contact so as to restrict a retreat of the sliding member.

In the hammer drill according to a ninth aspect of the disclosure, preferably, the mode switching member may include two eccentric pins to perform a rotating operation, and the one eccentric pin may be configured to move the sliding member in the opposite direction to the biasing direction in accordance with the rotating operation.

In the hammer drill according to a tenth aspect of the disclosure, preferably, the intermediate shaft may have an end portion on which a small diameter portion is disposed having a small diameter compared with an installation side of the conversion member. The gear may be externally installed on the small diameter portion such that the gear engages with an engaging portion disposed on a base of the small diameter portion on the engaging position to integrally rotate with the intermediate shaft.

In the hammer drill according to an eleventh aspect of the disclosure, preferably, the motor may be disposed below the intermediate shaft inside the housing in a direction where an axis line of the rotation shaft intersects with the intermediate shaft. A handlebar may be disposed on a rear of the tool holder.

In the hammer drill according to a twelfth aspect of the disclosure, preferably, the small diameter portion may have a front portion on which an O-ring is externally installed to retain the gear.

In the hammer drill according to a thirteenth aspect of the disclosure, preferably, the conversion member and the clutch may engage with one another such that a convex portion disposed on the one and a depressed portion disposed on the other mesh with one another in the rotation direction.

Meshing surfaces of the convex portion and the depressed portion each may have a shape such that the one is further displaced to the side meshing with the counterpart in the rotation direction on distal end side contact points where the one contacts with the meshing surface of the counterpart on a far side compared with base end side contact points where the one contacts with the meshing surface of the counterpart on a near side.

In a state where the convex portion and the depressed portion mesh with one another, the meshing surfaces may interfere with one another to generate a resistance in a separating direction of the conversion member and the clutch.

According to the disclosure, even in a small-sized hammer drill configured to select the operation mode depending on the front or rear position of the tool holder projectingly biased forward, the hammer mode is selectable, thus the further improvement of the usability is expected.

The configuration where the gear is slid to switch the operation mode provides an easy switching of the rotation transmission from the intermediate shaft by the slide of the gear.

The configuration where the drill mode is additionally selectable provides three operation modes, thus expanding the range of the work.

Employing the rotation restricting means ensures the tool bit to be locked to rotate in the hammer mode, thus making such as the chipping work easy.

Sliding the gear via the sliding member causes the switching of the slide position of the gear to be performed smoothly.

Moving the sliding member by the eccentric pin disposed on the mode switching member ensures the hammer mode to be selectable by the operation of single mode switching lever.

Disposing the gear on the small diameter portion disposed on the intermediate shaft downsizes the gear, thus leading to space saving.

Disposing the motor below the intermediate shaft and disposing the handlebar on the rear of the tool holder reduces the size in the front-rear direction due to the arrangement of the motor and handlebar, and the handlebar disposed just behind the tool holder applies the press load without a loss.

BRIEF DESCRIPTION OF THE DRAWINGS

FIG. 3A illustrates before meshing and FIG. 3B illustrates a meshing state.

FIG. 4A illustrates a switching position of a mode switching lever and FIG. 4B illustrates inside a front housing.

FIG. 5A illustrates the switching position of the mode switching lever and FIG. 5B illustrates inside the front housing.

FIG. 6A illustrates the switching position of the mode switching lever and FIG. 6B illustrates inside the front housing.

DETAILED DESCRIPTION

The following describes embodiments of the disclosure based on the drawings.

Figure 1:
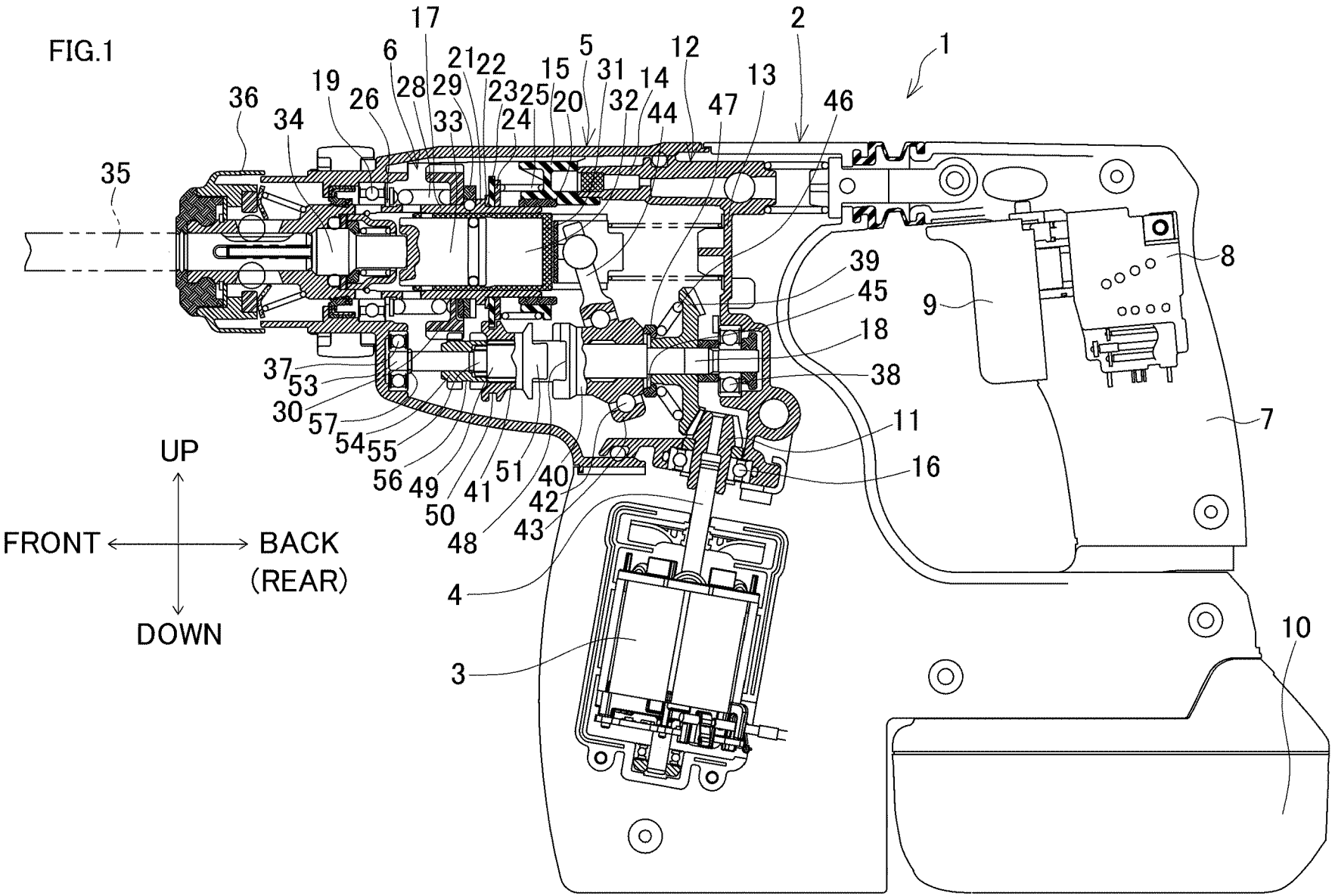
FIG. 1 is an overall view of a hammer drill (drill mode).

FIG. 1 is an overall view illustrating an exemplary hammer drill also served as a hammering tool, and an inside of a main body housing is omitted except a brushless motor and a switch. A hammer drill 1 includes a main body housing 2 that houses a brushless motor 3, a controller (not illustrated), and similar units. The hammer drill 1 includes a front housing 5 disposed to protrude forward on a front (left side in FIG. 1) upper portion of the main body housing 2, and a handlebar 7 on a position of a rear upper portion of the main body housing 2 and just rear of a tool holder 17 described later. The front housing 5 has a tapered tubular shape and houses an output unit 6. The handlebar 7 houses a switch 8 that includes a trigger 9. The hammer drill 1 includes a battery pack 10 as a power source installed on a rear lower portion of the main body housing 2.

The brushless motor 3 is housed in the main body housing 2 in an inclined posture with a rotation shaft 4 upward and obliquely rearward, and the rotation shaft 4 has a distal end on which a first gear (bevel gear) 11 is disposed to project inside the front housing 5.

The front housing 5 internally holds an inner housing 12. The inner housing 12 is constituted of a rear holder 13, a supporter 14, and a front holder 15. The rear holder 13 has an oval dish shape and is fitted to a rear end of the front housing 5 to be assembled between the main body housing 2 and the front housing 5. The supporter 14 projects forward from the rear holder 13. The front holder 15 has a ring shape and is screwed on a front end of the supporter 14. The first gear 11 of the rotation shaft 4 is journaled to a bearing 16, which is held onto the rear holder 13, to project into the front housing 5.

The front housing 5 houses the tubular tool holder 17 and an intermediate shaft 18, which is disposed just below the tool holder 17, ahead of the inner housing 12 in a front-rear direction. First, the tool holder 17 is pivotally supported to be rotatable and movable back and forth by a bearing 19 disposed on a front portion of the front housing 5 and a metal bearing 20 pressed into the front holder 15 of the inner housing 12.

Figure 2:
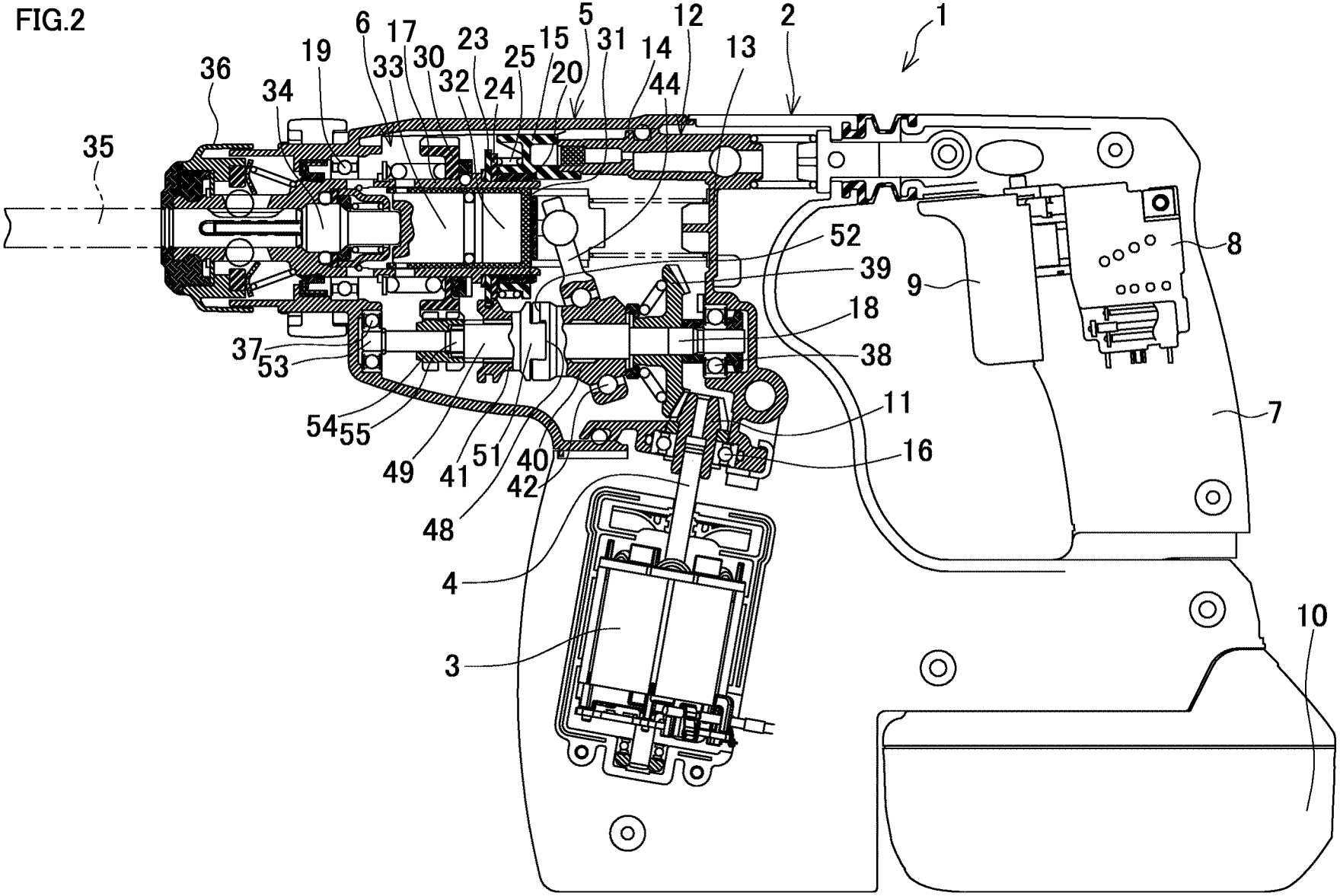
FIG. 2 is an overall view of the hammer drill (hammer drill mode).
Figure 4B:
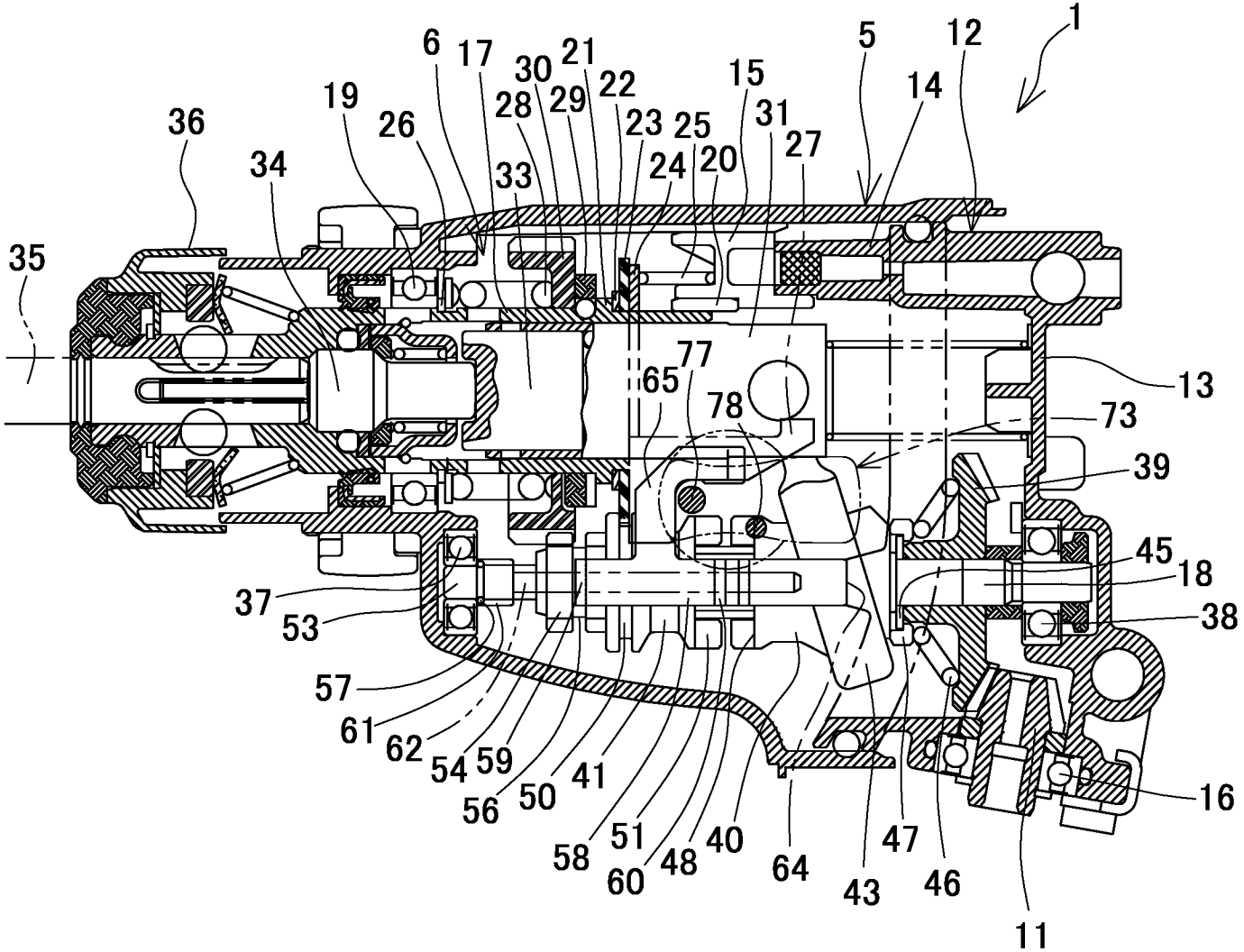
FIG. 4A and FIG. 4B are explanatory views of the drill mode.

The tool holder 17 has a rear outer periphery on which a flange 21 is disposed, and a locking plate 23 and a receiving plate 24 are externally installed on the rear of the flange 21 via a washer 22 in a stacked state. The tool holder 17 is projectingly biased to an advance position, where a stop ring 26 disposed on a front outer periphery abuts on the bearing 19, by a coil spring 25, which is externally installed between the receiving plate 24 and the front holder 15, in an ordinary state. The tool holder 17 is restricted to retreat on a position of FIG. 2 where the receiving plate 24 abuts on the metal bearing 20. As illustrated in FIG. 4B, the receiving plate 24 has a lower side portion on which a regulation plate 27, inverted L-shaped in a side view, is integrally formed.

The tool holder 17 has the outer periphery on which a fourth gear 30 with a torque limiter is externally installed between the flange 21 and the stop ring 26. The fourth gear 30 is configured to be pressed to a clutch plate 29 disposed on the tool holder 17 by a coil spring 28 so as to integrally rotate with the tool holder 17.

Furthermore, the tool holder 17 houses a piston cylinder 31 as a hammering member movable back and forth in a rear inner part. The piston cylinder 31 houses a striker 33 reciprocatable back and forth via an air chamber 32. Ahead of the striker 33, an impact bolt 34 is housed to be configured to abut on a rear end of a bit 35 inserted into a front end of the tool holder 17. The tool holder 17 has a front end on which an operation sleeve 36 for attaching and detaching the bit 35 is disposed.

Next, the intermediate shaft 18 is rotatably pivotally supported by a front bearing 37 disposed in the front housing 5 and a rear bearing 38 disposed in the rear holder 13 of the inner housing 12, thus meshing a second gear (bevel gear) 39 disposed on a rear portion with the first gear 11 of the rotation shaft 4. The intermediate shaft 18 includes a boss sleeve 40 and a clutch 41 externally installed from the rear side ahead of the second gear 39. The boss sleeve 40 is disposed as a conversion member to be independent of the intermediate shaft 18 and rotatable. The clutch 41 is configured to integrally rotate with the intermediate shaft 18. The boss sleeve 40 includes a swash bearing 42 inclined from an axis line. The swash bearing 42 has an outer ring 43 from which an arm 44 is disposed to protrude upward in a radiation direction, and the arm 44 has a distal end coupled to a rear end of the piston cylinder 31 of the tool holder 17. The boss sleeve 40 has a retreated position elastically restricted by a stopper ring 47. The stopper ring 47 is configured to be locked to a washer 45, interposed between the second gear 39 and the boss sleeve 40, from the rear and to be pressed to the washer 45 by a coil spring 46 disposed between the second gear 39 and the stopper ring 47. The boss sleeve 40 has a front surface on which a pair of depressed portions 48, 48 are disposed in point symmetry with a shaft center as the center.

The clutch 41 is configured to be coupled to a spline 49 disposed on the intermediate shaft 18 so as to be integrally rotatable and slidable in the axial direction. However, the outer periphery of the locking plate 23 disposed on the tool holder 17 is locked to a depressed groove 50 disposed on an outer periphery of a front end of the clutch 41, thus the clutch 41 moves back and forth in association with the tool holder 17. The clutch 41 has a rear surface on which a pair of convex portions 51, 51 are disposed in point symmetry with the shaft center as the center. The convex portions 51, 51 are fitted to the depressed portions 48, 48 of the boss sleeve 40 on a slide position (the meshing position) to the rear to mesh with the boss sleeve 40, while the meshing with the boss sleeve 40 is released on a slide position (non-meshing position) to the front.

Figure 3A:
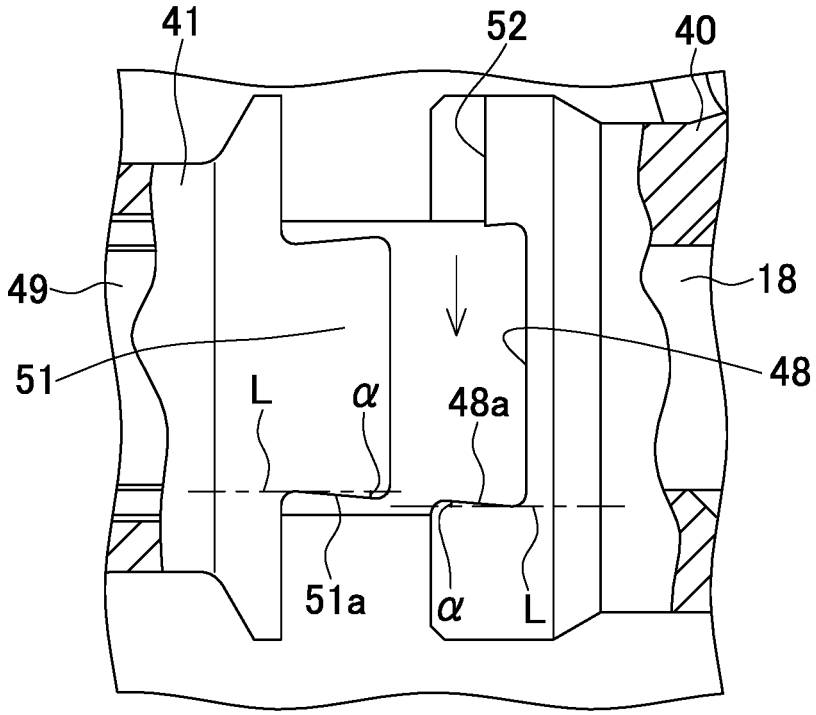
FIG. 3A and FIG. 3B are explanatory views of a meshing part of a clutch with a boss sleeve.

Here, as illustrated in FIG. 3A, each convex portion 51 of the clutch 41 is formed in an inverted tapered shape such that a width in the rotation direction (circumferential direction) is large on the distal end side compared with the base side, thus a meshing surface 51*a* formed on the outside surface of the convex portion 51 is outwardly inclined. This inclination angle $\alpha$ is configured in a range of, for example, 5° to 20° with respect to a straight line L parallel to the axis line of the intermediate shaft 18 viewing from the outside in the radiation direction.

On the other hand, each depressed portion 48 of the boss sleeve 40 is also formed in the inverted tapered shape such that a width in the rotation direction is small on the opening side compared with the bottom side, thus a meshing surface 48*a* formed on the inside surface of the depressed portion 48 is inwardly inclined. The inclination angle $\alpha$ is configured similarly to the convex portion 51 of the clutch 41.

However, the front surface of the boss sleeve 40 includes an escaping portion 52 where an inside surface on the opposite side of the meshing surface 48*a* on each depressed portion 48 is shallowed (lowered) because the convex portion 51 of the clutch 41 meshes with the depressed portion 48 from a left rotation direction (arrow direction of FIG. 3A) toward front.

Figure 3B:
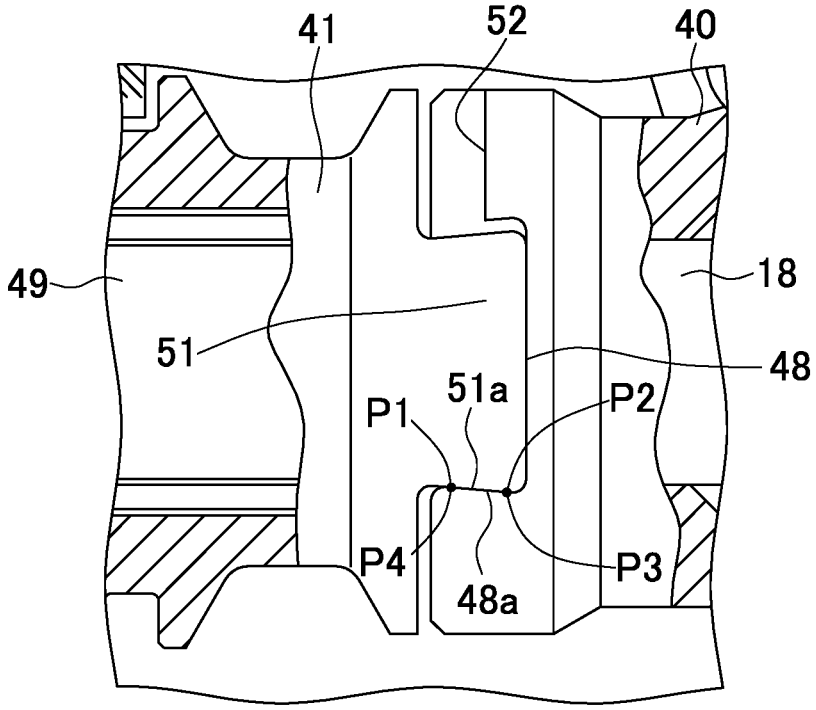

Accordingly, in a state where the clutch 41 retreats to mesh with the boss sleeve 40 on the depressed portion 48 and the convex portion 51, as illustrated in FIG. 3B, the meshing surface 51*a* of the convex portion 51 has contact points with the meshing surface 48*a* of the depressed portion 48 on both front and rear ends such that a distal end side contact point P2 is further displaced to the side (lower side in FIG. 3B) meshing with the counterpart in the rotation direction compared with a base side contact point (base end side contact point) P1. On the other hand, the meshing surface 48*a* of the depressed portion 48 has contact points with the meshing surface 51*a* of the convex portion 51 on both front and rear ends such that an opening side contact point (distal end side contact point) P4 is further displaced to the side (upper side in FIG. 3B) meshing with the counterpart in the rotation direction compared with a bottom side contact point (base end side contact point) P3. That is, the distal end side contact points P2 and P4 are further displaced to the side meshing with the counterpart in the rotation direction compared with the base end side contact points P1 and P3. At this time, a part of the meshing surface 51*a* between the base side contact point P1 and the distal end side contact point P2 is in contact with a part of the meshing surface 48*a* between the bottom side contact point P3 and the opening side contact point P4 over the whole surface one another. Then, in an engaged state of the boss sleeve 40 with the clutch 41, the meshing surfaces 48*a* and 51*a* interfere with one another in a direction separating from one another so as to generate resistance.

On the other hand, ahead of the spline 49 on the intermediate shaft 18, a small diameter portion 53 having a small diameter compared with the spline 49 is disposed, and on the small diameter portion 53, a third gear 54 as a gear of this disclosure is rotatably externally installed to mesh with the fourth gear 30 of the tool holder 17. The third gear 54 is configured to move back and forth between a retreated position (engaging position (first state)) in FIGS. 1 and 2 and an advance position (non-engaging position (second state)) in FIG. 6B. The retreated position is a position where the inner periphery of the third gear 54 meshes with a gear portion 55, disposed on the base of the small diameter portion 53, as an engaging portion to be integrated with the intermediate shaft 18 in the rotation direction. The advance position is a position where the third gear 54 is separated from the gear portion 55 to be independent of the intermediate shaft 18 in the rotation direction. The third gear 54 has the outer periphery on which a ring-shaped locking groove 56 is depressed. An O-ring 57 is externally installed on the front portion of the small diameter portion 53 and the end of the rear surface of the front bearing 37. Externally installing the third gear 54 on the small diameter portion 53 to install the O-ring 57 causes the O-ring 57 to function as a retainer of the third gear 54, thus making the assembling to the front housing 5 easy.

Figure 7:
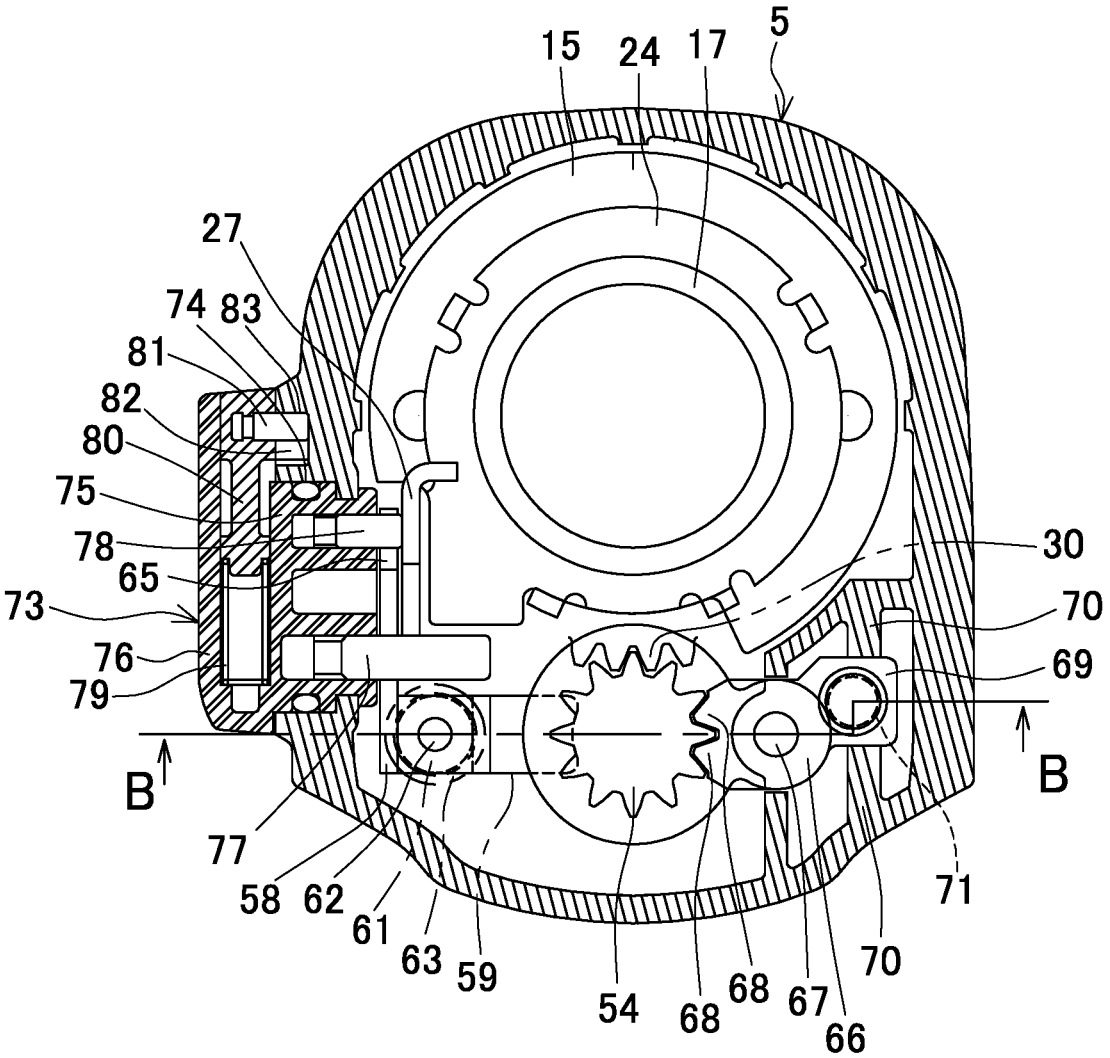
FIG. 7 is a cross-sectional view taken along the line A-A of FIG. 5B.
Figure 8:
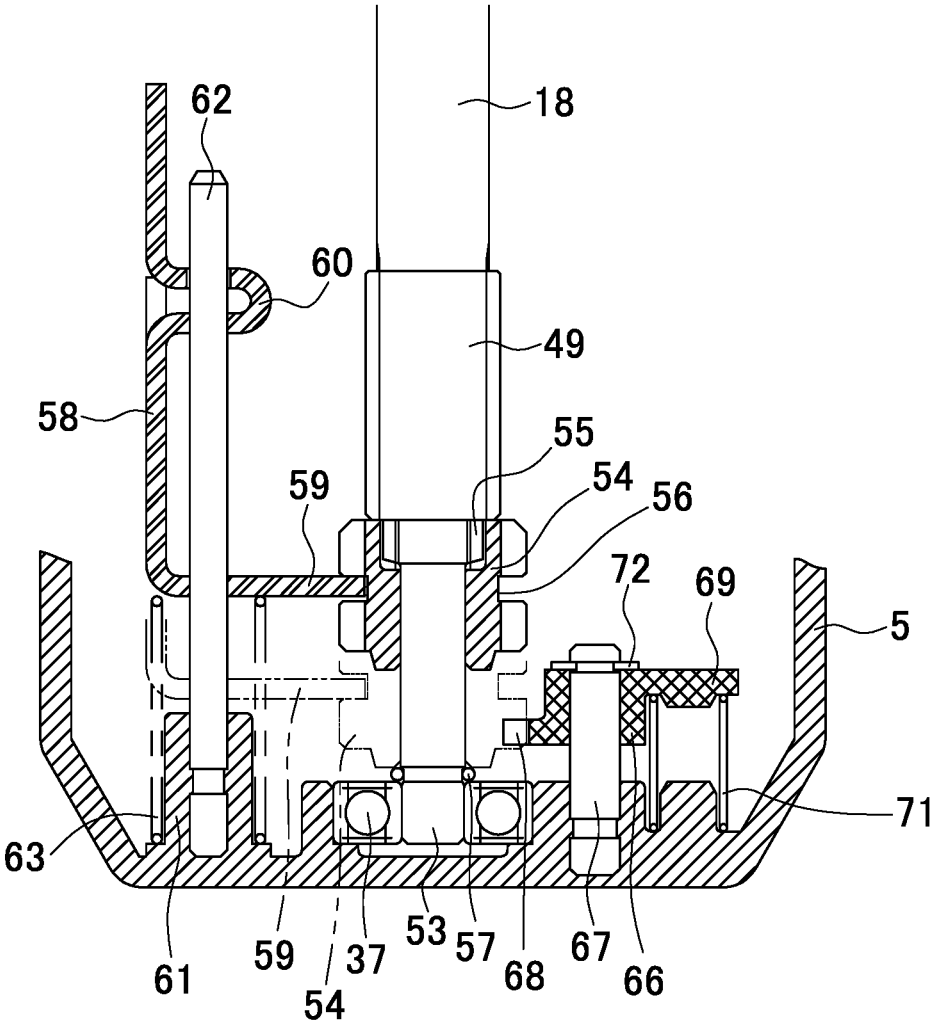
FIG. 8 is a cross-sectional view taken along the line B-B of FIG. 7.

A slide plate 58 is a sliding member disposed on the side of the intermediate shaft 18 and extending in a strip shape in the front-rear direction. As illustrated in FIGS. 7 and 8, the slide plate 58 has a front end on which a lock piece 59 is disposed to be orthogonally bent to the intermediate shaft 18 side, such that the lock piece 59 is locked to the locking groove 56 of the third gear 54. The slide plate 58 has an intermediate portion as a folded portion 60 extending to the intermediate shaft 18 side parallel to the lock piece 59. A guide shaft 62 passes through the folded portion 60 and the lock piece 59 such that the guide shaft 62 has a front end inserted to be coupled to a boss 61 disposed to protrude on the side of the front bearing 37 inside the front housing 5, so that the guide shaft 62 projects rearward parallel to the intermediate shaft 18. On the guide shaft 62, a coil spring 63 that has a front end externally installed on the boss 61 and a rear end abutting on the lock piece 59 is externally installed as a biasing means.

Then, while the slide plate 58 is biased rearward in the ordinary state, the slide plate 58 is restricted to retreat on a position abutting on a stopper portion 64 (FIG. 4B) disposed on the outer periphery of the rear holder 13 of the inner housing 12. This retreated position is also a retreated position of the third gear 54, which simultaneously retreats via the lock piece 59, to mesh with the gear portion 55. The slide plate 58 includes a contact piece 65 between the lock piece 59 and the folded portion 60 such that the contact piece 65 has an inverse L shape extending upward subsequently bent rearward. The rearwardly bent portion of the contact piece 65 is disposed on a position overlapping the regulation plate 27 of the receiving plate 24 from the outer side.

Furthermore, as illustrated in FIGS. 7 and 8, a locking member 66 is disposed on the opposite side of the guide shaft 62 across the intermediate shaft 18 on the inner surface of the front side of the front housing 5. A support pin 67, disposed upright from the front housing 5 parallel to the intermediate shaft 18 as illustrated in FIG. 8, penetrates to support the locking member 66. The locking member 66 has locking claws 68, 68 disposed to protrude on the intermediate shaft 18 side to be meshed with the third gear 54 on the advance position. The locking member 66 includes a positioning piece 69 disposed to protrude on the opposite side of the locking claw 68, such that the positioning piece 69 is guided to ribs 70, 70 disposed in the front housing 5 so as to restrict the rotation of the locking member 66. The locking member 66 is biased to the retreated position where the locking member 66 abuts on a clip 72 disposed on the distal end of the support pin 67 by a coil spring 71 disposed between the positioning piece 69 and the front housing 5. That is, the locking member 66, the support pin 67, and the coil spring 71 constitute a rotation restricting means that restricts the rotation of the third gear 54 on the advance position.

Then, a mode switching lever 73 as a mode switching member is disposed on the side surface of the front housing 5. As illustrated in FIG. 7, the mode switching lever 73 is constituted of a disc-shaped rotating portion 75, which is rotatably fitted to a fitting hole 74 disposed on the front housing 5, and a knob portion 76 disposed on the outer surface of the rotating portion 75 to be exposed outside the front housing 5. The rotating portion 75 includes two long and short eccentric pins of a first eccentric pin 77 and a second eccentric pin 78 decentered from the rotational center to protrude to the intermediate shaft 18 side. The first eccentric pin 77 as the longer eccentric pin has a length such that the first eccentric pin 77 projects into the front housing 5 through the rear of the contact piece 65 of the slide plate 58 and the regulation plate 27 of the receiving plate 24 over both plates 58 and 24 above the slide plate 58. The second eccentric pin 78 as the shorter eccentric pin also projects into the front housing 5 through the rear of the contact piece 65 and the regulation plate 27 above the slide plate 58, while the distal end of the second eccentric pin 78 is confined to the position interfering with the contact piece 65 in the front-rear direction so as to have a length without the interference with the regulation plate 27. Here, the second eccentric pin 78 is configured such that the upper side of the moving trajectory overlaps the extended line of the distal end of the contact piece 65.

In the hammer drill 1 configured as described above, when the knob portion 76 of the mode switching lever 73 is gripped and the rotating portion 75 is rotated by 90°, the first and the second eccentric pins 77 and 78 rotationally move, thus the slide of the receiving plate 24 and/or the slide plate 58 is restricted or the restrict of the slide of the receiving plate 24 and/or the slide plate 58 is released. In the above configuration, a choice of the three operation modes of the drill mode, the hammer drill mode, and the hammer mode is provided. The knob portion 76 includes a lock button 80 biased to project by a coil spring 79, such that a pin 81 disposed on the lock button 80 moves along the inside of an arc-shaped guide groove 82 disposed on the outer surface of the front housing 5 in accordance with the rotation of the mode switching lever 73. On a position of the corresponding operation mode, the pin 81 locks to a lock portion 83 disposed on the outer side of the guide groove 82 to maintain the operation mode. The following describes each operation mode.

Figure 4A:
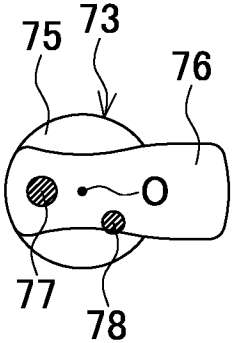

First, on the rotation position of the mode switching lever 73 where the knob portion 76 is laid rearward, as illustrated in FIGS. 4A and 4B, the first eccentric pin 77 is positioned forward a rotational center O of the rotating portion 75 and the second eccentric pin 78 is positioned rearward the rotational center O, such that the first eccentric pin 77 is close to the rear edge of the regulation plate 27 of the receiving plate 24 existing on the advance position with the tool holder 17. At this time, the slide plate 58 is positioned on the retreated position where the slide plate 58 is brought in contact with the stopper portion 64 to cause the third gear 54 to mesh with the gear portion 55.

Accordingly, the first eccentric pin 77 restricts the tool holder 17 to retreat via the regulation plate 27 of the receiving plate 24 so as to maintain the advance position where the clutch 41 leaves the boss sleeve 40, thus the operation mode is set in the drill mode where the third gear 54 is coupled to the intermediate shaft 18.

In this state, when the trigger 9 is pushed to turn ON the switch 8 so as to drive the brushless motor 3, the rotation shaft 4 is rotated to cause the second gear 39 to decelerat-ingly rotate the intermediate shaft 18 via the first gear 11. At this time, while the clutch 41 and the third gear 54 integrat-edly rotate, the boss sleeve 40 does not rotate because the clutch 41 does not mesh with the boss sleeve 40, thus the piston cylinder 31 does not operate. Then, the rotation of the third gear 54 is transmitted to the tool holder 17 via the fourth gear 30 to rotate the bit 35. Even when the bit 35 is pressed onto a workpiece to push the tool holder 17, the drill mode is maintained because the receiving plate 24 is restricted to retreat.

Figure 5B:
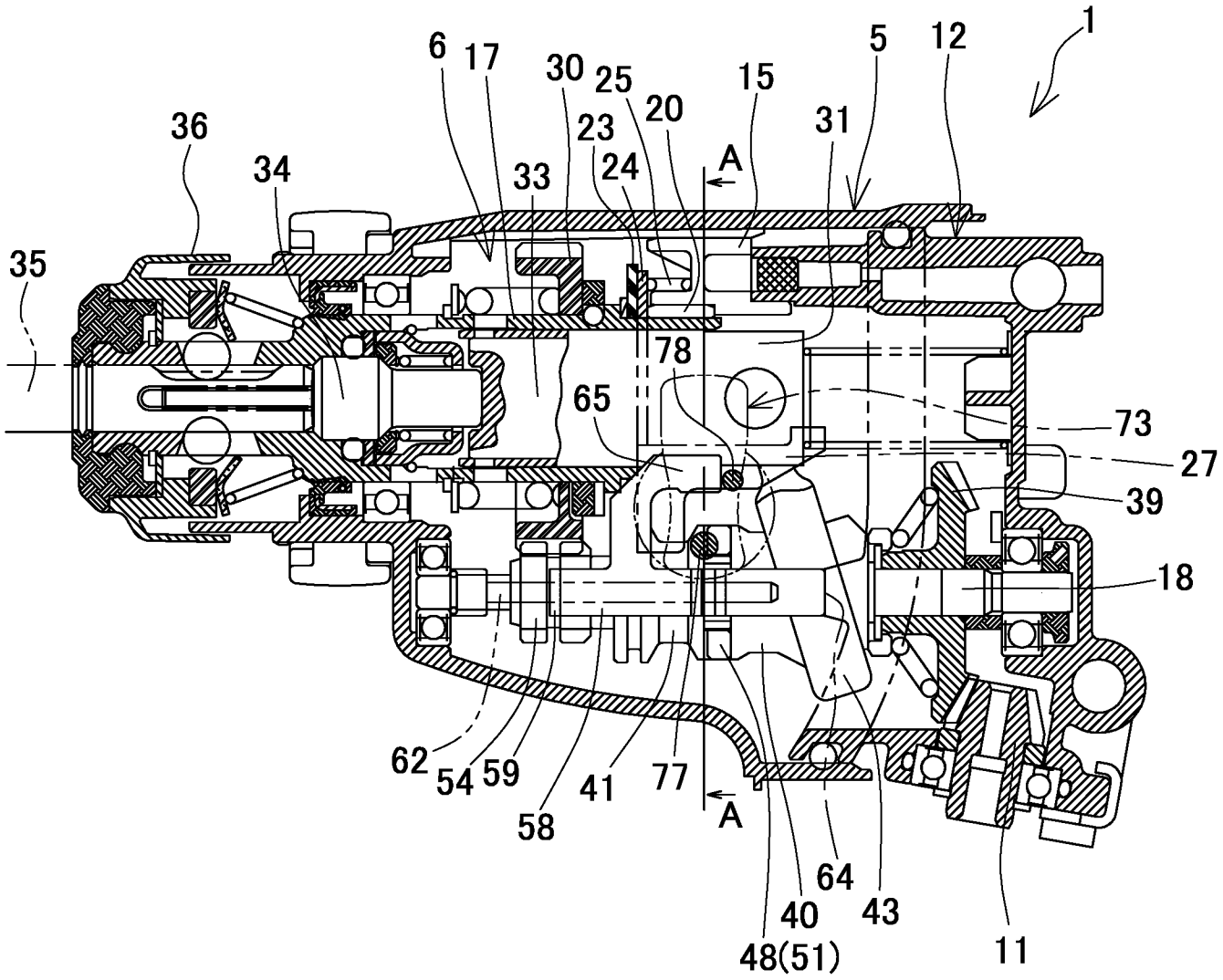
FIG. 5A and FIG. 5B are explanatory views of the hammer drill mode.
Figure 5A:
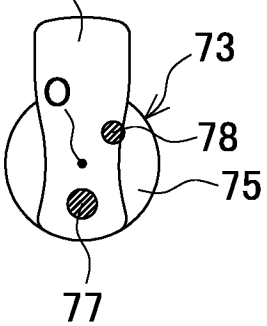

Next, on the rotation position of the mode switching lever 73 where the knob portion 76 is rotated upward by 90°, as illustrated in FIGS. 5A and 5B, the first eccentric pin 77 is positioned below the rotational center O of the rotating portion 75 to leave the regulation plate 27 of the receiving plate 24 rearward, and the second eccentric pin 78 moves to the upper side of the rotational center O to be close to the distal end of the contact piece 65. The slide plate 58 stays on the retreated position.

Accordingly, the first eccentric pin 77 does not restrict the tool holder 17 to retreat, thus the operation mode is set in the hammer drill mode where the tool holder 17 is movable to the retreated position with the clutch 41. That is, when the bit 35 is pressed onto the workpiece to push the tool holder 17 into the front housing 5, the convex portions 51, 51 of the clutch 41 retreated with the tool holder 17 mesh with the depressed portions 48, 48 of the boss sleeve 40 to transmit the rotation of the clutch 41 to the boss sleeve 40. The third gear 54 and the fourth gear 30 stay in the meshing state.

In this state, when the intermediate shaft 18 rotates, the rotation of the clutch 41 is transmitted to the boss sleeve 40 to cause the swash bearing 42 to swing the arm 44 back and forth, thus moving the piston cylinder 31 back and forth. Then, the striker 33 is in conjunction to reciprocate via the air chamber 32 to indirectly hammer the bit 35 via the impact bolt 34. Simultaneously, the tool holder 17 rotates to rotate the bit 35.

When the hammer drill 1 is used in the hammer drill mode, even if the force to press the bit 35 onto such as the ground is decreased to decrease a press load of the tool holder 17, as illustrated in FIG. 3B, a resistance is generated between the convex portions 51, 51 of the clutch 41 and the depressed portions 48, 48 of the boss sleeve 40 in a direction separating from one another due to the contact of the inclined meshing surfaces 51*a* and 48*a*. Therefore, the tool holder 17 and the clutch 41 are restricted to advance against the biasing by the coil spring 25, thus the engagement of the clutch 41 with the boss sleeve 40 is maintained. This decreases the possibility of the hammering operation to be interrupted during the work.

Figure 6B:
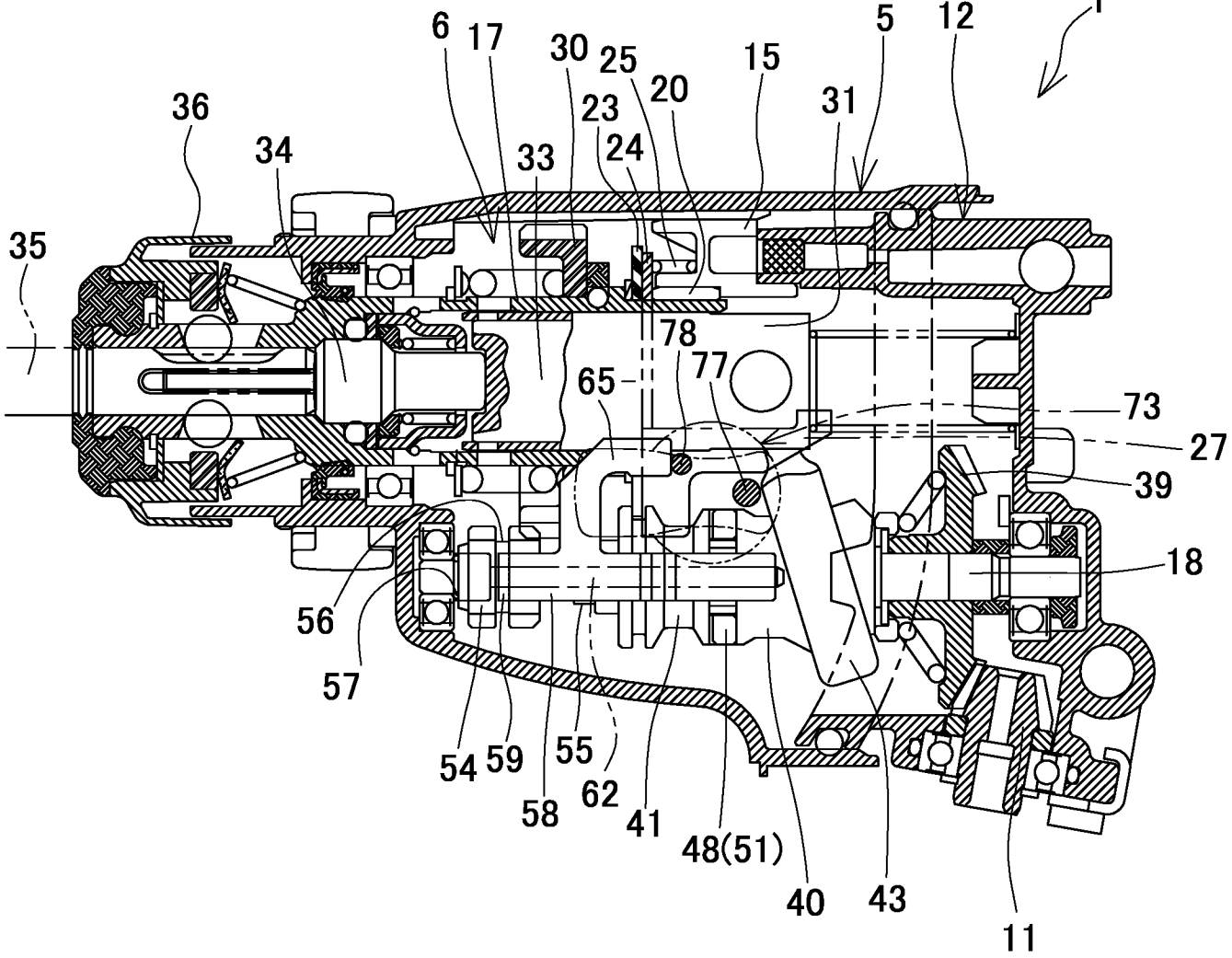
FIG. 6A and FIG. 6B are explanatory views of a hammer mode.
Figure 6A:
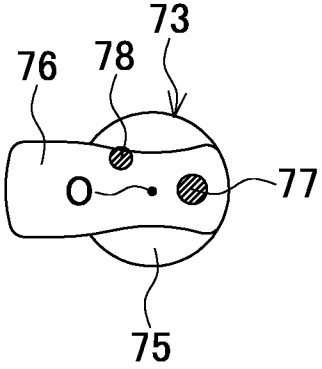
Figure 9:
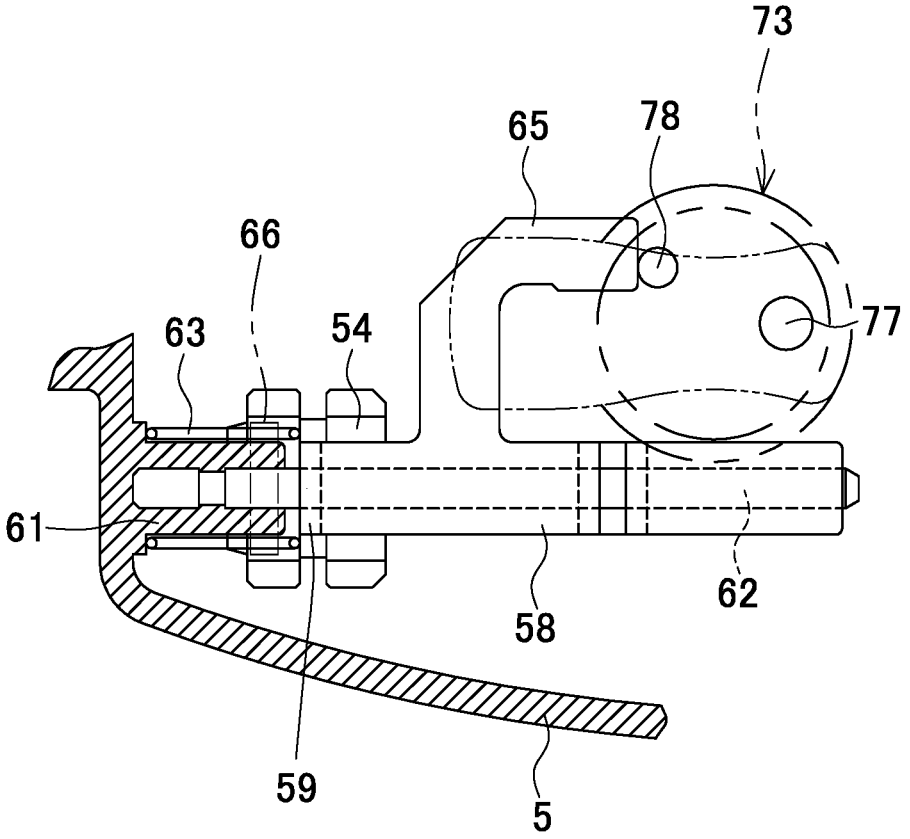
FIG. 9 is an explanatory view illustrating a positional relation between a slide plate and the mode switching lever in the hammer mode.

Next, on the rotation position of the mode switching lever 73 where the knob portion 76 is rotated forward by 90°, as illustrated in FIGS. 6A and 6B, the first eccentric pin 77 is positioned rearward the rotational center O, and the second eccentric pin 78 is positioned forward the rotational center O so as to move the slide plate 58 to the advance position via the contact piece 65 against the biasing by the coil spring 63 as illustrated in FIG. 9.

Accordingly, while the tool holder 17 is not restricted to retreat and is allowed to move to the retreated position with the clutch 41, the third gear 54 that has moved to the advance position with the slide plate 58 leaves the gear portion 55, thus the operation mode is set in the hammer mode where the rotation of the intermediate shaft 18 is not transmitted. That is, when the intermediate shaft 18 rotates in a state where the tool holder 17 is pushed in, the rotation of the clutch 41 is transmitted to the boss sleeve 40 to cause the piston cylinder 31 to move back and forth, so as to cause the striker 33 to reciprocate, thus hammering the bit 35 via the impact bolt 34. However, since the third gear 54 that has left the gear portion 55 does not rotate, the tool holder 17 does not rotate.

In the hammer mode, even if the press load of the tool holder 17 is decreased, the resistance is also generated between the convex portions 51, 51 of the clutch 41 and the depressed portions 48, 48 of the boss sleeve 40 in the direction separating from one another due to the contact of the inclined meshing surfaces 51*a* and 48*a* as illustrated in FIG. 3B. Therefore, the engagement of the clutch 41 and the boss sleeve 40 is maintained, thus the possibility of the hammering operation to be interrupted is decreased.

The third gear 54 is restricted to rotate by locking of the locking claw 68 of the locking member 66 on the advance position, thus locking the rotation of the tool holder 17 via the fourth gear 30. Then, when the angle of the bit 35 such as a chisel is set to an easy-to-use angle in changing to the hammer mode, the bit 35 is used as while it is being locked. When the third gear 54 moves forward, if the locking claw 68 of the locking member 66 is not properly locked, the locking member 66 is pushed forward against the biasing by the coil spring 71. However, when the tool holder 17 is rotated via the bit 35, the third gear 54 is rotated via the fourth gear 30, thus the locking member 66 is returned to the advance position on the position where the locking claw 68 is locked so as to lock the locking member 66.

Thus, according to the hammer drill 1 with the above-described configuration, the third gear 54 is configured to be switched to a first state (engaging position with the inter-mediate shaft 18) where the rotation of the intermediate shaft 18 is transmitted and a second state (non-engaging position with the intermediate shaft 18) where the rotation of the intermediate shaft 18 is not transmitted. At the same time, the mode switching lever 73 is configured to perform the switching operation on the state of the third gear 54 from the outside of the front housing 5. Then, the hammer drill 1 is configured such that switching the state of the third gear 54 by the mode switching lever 73 provides at least two selectable operation modes. The two operation modes includes the hammer drill mode where the third gear 54 integrally rotates with the intermediate shaft 18 to generate the rotation and the reciprocation of the piston cylinder 31 on the tool holder 17 and the hammer mode where the third gear 54 is separated from the rotation of the intermediate shaft 18 to generate only the reciprocation of the piston cylinder 31.

Accordingly, even the small-sized hammer drill 1, which is configured to select the operation mode depending on the front or rear position of the tool holder 17 projectingly biased forward, selects the hammer mode, thus the further improvement of the usability is expected.

The third gear 54 is configured to be switched to the first state and the second state by sliding between the engaging position, where the third gear 54 is engaged with the intermediate shaft 18 to be integrally rotated, and the non-engaging position, where the engagement with the intermediate shaft 18 is released. The mode switching lever 73 is configured to perform the switching operation on the slide position of the third gear 54 from the outside of the front housing 5. Then, the rotation transmission from the intermediate shaft 18 can be easily switched by the slide of the third gear 54.

Especially, here, the mode switching lever 73 is configured to switch the slide position of the clutch 41 to a meshing position where the clutch 41 meshes with the boss sleeve 40 to integrally rotate and a non-meshing position where the meshing with the boss sleeve 40 is released. The drill mode is also selectable by switching the mode switching lever 73 from the engaging position of the third gear 54 to the non-meshing position of the clutch 41. The drill mode is a mode where the third gear 54 integrally rotates with the intermediate shaft 18 to generate only the rotation on the tool holder 17. Therefore, in addition to the hammer mode and the hammer drill mode, the drill mode is enabled to be used, thus by which the range of the work is expanded.

The rotation restricting means (the locking member 66, the support pin 67, and the coil spring 71) is disposed to restrict the rotation of the third gear 54 on the non-engaging position of the third gear 54, such that the rotation of the bit 35 in the hammer mode is locked. Therefore, a chipping work or the like is made easy.

Furthermore, the front housing 5 internally includes the guide shaft 62 supported parallel to the intermediate shaft 18, the slide plate 58 locking to the third gear 54 to be movable back and forth along the guide shaft 62, and the coil spring 63 biasing the slide plate 58 to the engaging position of the third gear 54. In accordance with the switching operation of the mode switching lever 73, the slide plate 58 moves in an opposite direction to the biasing direction of the coil spring 63 so as to slide the third gear 54 to the non-engaging position. Thus, the slide position of the third gear 54 is smoothly switched.

Additionally, the mode switching lever 73 is configured to include the two first and second eccentric pins 77 and 78 to be performed with the rotating operation, and the second eccentric pin 78 moves the slide plate 58 in the opposite direction to the biasing direction in accordance with the rotating operation. Accordingly, the hammer mode is selected by the operation of single mode switching lever 73.

Then, the intermediate shaft 18 has the front end on which the small diameter portion 53 is disposed. The small diameter portion 53 has the small diameter compared with the installation side of the boss sleeve 40. The third gear 54 is externally installed on the small diameter portion 53. The third gear 54 is engaged with the gear portion 55, disposed on the base of the small diameter portion 53, so as to be integrally rotated with the intermediate shaft 18 on the engaging position, thus downsizing the third gear 54 to lead to space saving.

The brushless motor 3 is disposed below the intermediate shaft 18 inside the main body housing 2 in the direction where the axis line of the rotation shaft 4 intersects with the intermediate shaft 18, and the handlebar 7 is disposed on the rear of the tool holder 17. This reduces the size in the front-rear direction, and the handlebar 7 disposed just behind the tool holder 17 applies the press load without a loss.

In the disclosure configured to select the hammer mode, the structures of the receiving plate, the slide plate, and the rotation restricting means are not limited to the above-described configuration, and can be changed as necessary such that, for example, the shapes of the regulation plate and the contact piece are changed, or the slide plate is configured to be guided by such as a rib disposed on the inner surface of the housing instead of the guide shaft. The rotation restricting means can be omitted.

The above configuration includes the clutch configured to engage with and disengage from the conversion member such as the boss sleeve so as to select the hammering operation. However, the hammer drill may employ a configuration such that the clutch is not disposed, the conversion member integrally rotates with the intermediate shaft, and two operation modes of the hammer mode and the hammer drill mode are selectable by switching the slide position of the gear for the rotation transmission.

Furthermore, the above configuration includes the gear (the third gear) configured to slide to switch the rotation transmission from the intermediate shaft. However, a configuration can be employed such that the gear is disposed not to be slided but to be in a state of freely rotational with respect to the intermediate shaft and the intermediate shaft includes a clutch member configured to be integrally rotatable and slidable in the axial direction so as to engage with and disengage from the clutch member with the gear by the mode switching member so that the rotation transmission from the intermediate shaft is switched.

On the other hand, according to the hammer drill 1 with the above-described configuration, the meshing surfaces 51*a* and 48*a* each have a shape such that the one is further displaced to the side meshing with the counterpart in the rotation direction on the distal end side contact points P2 and P4, where the one contacts with the meshing surface of the counterpart on the far side, compared with the base end side contact points P1 and P3 where the one contacts with the meshing surface of the counterpart on the near side. In a state where the convex portion 51 and the depressed portion 48 mesh with one another, the meshing surfaces 51*a* and 48*a* interfere with one another to generate the resistance in the separating direction of the boss sleeve 40 and the clutch 41.

Accordingly, even in the hammer drill configured such that the clutch 41, which has retreated with the tool holder 17 projectingly biased forward, engages with the boss sleeve 40 to allow the hammer drill mode and the hammer mode to be selected, it decreases the possibility where the engagement of the clutch 41 with the boss sleeve 40 is released, thus maintaining the satisfactory workability.

In particular, here, in a state where the convex portion 51 and the depressed portion 48 mesh with one another, the meshing surfaces 51*a* and 48*a* are in contact with one another on the whole surface between the base end side contact point P1 (P3) and the distal end side contact point P2 (P4). Therefore, the interference of the meshing surfaces 51*a* and 48*a* with one another in the separating direction increases, thus decreasing the possibility where the engagement of the clutch 41 is released.

The convex portion 51 has the inverted tapered shape where the distal end side has the large width in the rotation direction compared with the base side and the inclined outer surface is the meshing surface 51*a*, and the depressed portion 48 has the inverted tapered shape where the opening side has the small width in the rotation direction compared with the bottom side and the inclined inner surface is the meshing surface 48*a*. Then, the meshing surfaces 51*a* and 48*a* is easily disposed so as to decrease the possibility where the engagement is released.

Furthermore, both meshing surfaces 51*a* and 48*a* of the convex portion 51 and the depressed portion 48 are configured to have the inclination angle in a range of 5° to 20° with respect to the straight line L parallel to the axis line of the intermediate shaft 18, thus allowing the meshing surfaces 51*a* and 48*a* to be configured to be easily engaged with and hardly removed from one another.

Additionally, the boss sleeve 40, on which the depressed portion 48 is disposed, has the end surface that includes the escaping portion 52 where the inside surface on the opposite side of the meshing surface 48*a* with the convex portion 51 is shallowed compared with the meshing surface 48*a*, such that the convex portion 51 easily enters into the depressed portion 48 to smoothly mesh with one another.

In the disclosure according to the shape of the convex portion and the depressed portion, the number of the convex and depressed portions is not limited to the above configuration. The convex and depressed portions may be disposed three or more, and may be configured to have a shape where only the surface on the meshing side is inclined instead of the inverted tapered shape where both side surfaces are inclined.

While the meshing surfaces of the convex and depressed portions are formed in the inclined planar surface in the above configuration, a configuration may be employed such that the one meshing surface of the convex and depressed portions is formed in a convex curved surface bulging in an arc shape and the other meshing surface is formed in a depressed curved surface to which the bulging portion fits.

Furthermore, not the whole surface of the meshing surface is required to be formed in the inclined planar surface or the curved surface, and a configuration may be employed such that, for example, the convex portion has the base side having the identical width and the distal end side in the inverted tapered shape while the corresponding depressed portion has bottom side in the inverted tapered shape and the opening side having the identical width. That is, the meshing surfaces where the interference is generated in the separating direction may be disposed on a part of the side surface of the convex portion and the depressed portion, respectively. Therefore, even on the convex portion, where a half of the base side is formed in the inclined planar surface and the curved surface and a half of the distal end side is tapered, and the depressed portion fitting to the convex portion, the interference is generated between the base side of the convex portion and the opening side of the depressed portion in the separating direction.

Then, while the above configuration includes the third gear configured to slide to select the hammer mode, the disclosure according to the shape of the convex portion and the depressed portion is applicable to even other hammering tools such as a hammer drill where the third gear is configured not to be slided and only the two operation modes of the drill mode and the hammer drill mode are selectable by the back-and-forth movement of the tool holder and the clutch.

It is explicitly stated that all features disclosed in the description and/or the claims are intended to be disclosed separately and independently from each other for the purpose of original disclosure as well as for the purpose of restricting the claimed invention independent of the composition of the features in the embodiments and/or the claims. It is explicitly stated that all value ranges or indications of groups of entities disclose every possible intermediate value or intermediate entity for the purpose of original disclosure as well as for the purpose of restricting the claimed invention, in particular as limits of value ranges.

What is claimed is:

1. A hammer drill comprising:

a housing configured to house a motor;

a tool holder configured to hold a tool bit, the tool holder being disposed in the housing and configured such that an entirety of the tool holder is movable back and forth between a front position and a rear position in the housing;

a hammering member disposed movable back and forth inside the tool holder;

an intermediate shaft disposed parallel to the tool holder inside the housing, a rotation of the motor being transmitted to the intermediate shaft to cause rotation of the intermediate shaft;

a gear disposed on the intermediate shaft, the gear selectively transmitting the rotation of the intermediate shaft to the tool holder to cause rotation of the tool holder; and a conversion member disposed on the intermediate shaft, the conversion member converting the rotation of the intermediate shaft to a reciprocation of the hammering member, wherein:

the gear is configured to be switched to a first state where the rotation of the intermediate shaft is transmitted to the tool holder and a second state where the rotation of the intermediate shaft is not transmitted to the tool holder, and a mode switching member is configured to perform a switching operation of the gear between the first state and the second state from an outside of the housing;

switching of the gear by the mode switching member between the first state and the second state provides at least two operation modes of (1) a hammer drill mode where the gear integrally rotates with the intermediate shaft to generate the rotation of the tool holder and the reciprocation of the hammering member and (2) a hammer mode where the gear is separated from the rotation of the intermediate shaft to generate only the reciprocation of the hammering member;

the entirety of the tool holder is movable to the rear position only when the hammer mode and the hammer drill mode are alternatively selected; and the entirety of the tool holder is not movable and cannot be moved to the rear position when the hammer drill is in a mode other than the hammer mode or the hammer drill mode.

2. The hammer drill according to claim 1, wherein the gear is configured to slide between an engaging position where the gear engages with the intermediate shaft to integrally rotate and a non-engaging position where the gear does not engage the intermediate shaft so as to switch the gear between the first state and the second state.

3. The hammer drill according to claim 2, further comprising a clutch disposed on the intermediate shaft integrally rotatable and slidable in an axial direction, the clutch being configured to move back and forth when the tool holder is moved back and forth so as to engage with and disengage from the conversion member, wherein the mode switching member is configured to switch the clutch to a meshing position where the clutch meshes with the conversion member to integrally rotate and a non-meshing position where the clutch does not mesh with the conversion member, and when the gear is in the engaging position and the clutch is in the non-meshing position, the hammer drill is in a drill mode in which the tool holder is rotated.

4. The hammer drill according to claim 3, wherein;

the conversion member and the clutch engage such that a convex portion disposed on one of the conversion member and the clutch and a depressed portion disposed on another of the conversion member and the clutch mesh in a rotation direction, meshing surfaces of the convex portion and the depressed portion each have a shape such that the one of the conversion member and the clutch is further displaced to the side when meshing with the another of the conversion member and the clutch in the rotation direction on distal end side contact points, and in a state where the convex portion and the depressed portion mesh with one another, the meshing surfaces interfere to generate a resistance in a separating direction of the conversion member and the clutch.

5. The hammer drill according to claim 2, wherein a rotation restricting unit is disposed to selectively restrict rotation of the gear.

6. The hammer drill according to claim 5, wherein the rotation restricting unit includes a support pin disposed upright from an inner surface of the housing parallel to the intermediate shaft, a locking member penetrated and supported by the support pin to mesh with the gear, and a coil spring that biases the locking member to a meshing position with the gear.

7. The hammer drill according to claim 2, wherein the housing includes an internal guide shaft supported parallel to the intermediate shaft, a sliding member configured to lock on the gear to move back and forth along the guide shaft, and a biasing unit that biases the sliding member to the engaging position of the gear, and the sliding member moves in an opposite direction to a biasing direction of the biasing unit in accordance with operation of the mode switching member, such that the gear slides to the non-engaging position.

8. The hammer drill according to claim 7, wherein the sliding member is disposed on a side of the intermediate shaft.

9. The hammer drill according to claim 7, wherein the housing includes an internal inner housing configured to support a rear end of the intermediate shaft, and the inner housing includes a stopper portion with which the sliding member is brought in contact so as to restrict a retreat of the sliding member.

10. The hammer drill according to claim 7, wherein the mode switching member includes two eccentric pins to perform a rotating operation, and one of the two eccentric pins is configured to move the sliding member in an opposite direction to the biasing direction in accordance with the rotating operation.

11. The hammer drill according to claim 2, wherein the intermediate shaft has an end portion having a small diameter compared with an installation side of the conversion member, and the gear is externally installed on the end portion such that the gear engages with an engaging portion disposed on a base of the end portion to integrally rotate with the intermediate shaft.

12. The hammer drill according to claim 11, wherein the end portion has a front portion on which an O-ring is externally installed to retain the gear.

13. The hammer drill according to claim 1, wherein the motor is disposed below the intermediate shaft inside the housing, and a handlebar is disposed on a rear of the tool holder.

14. The hammer drill according to claim 1, wherein the hammer drill operates in hammer mode or the hammer drill mode when the tool holder is in the rear position, but not when the tool holder is in the front position.

15. The hammer drill according to claim 1, wherein the hammer drill operates in a drill only mode when the tool holder is in the front position.

16. The hammer drill according to claim 1, wherein when the hammer mode and the hammer drill mode are alternatively implemented, the tool holder is in the rear position.

17. A hammer drill comprising:

a housing configured to house a motor;

a tool holder configured to hold a tool bit, the tool holder being disposed in the housing and configured such that an entirety of the tool holder is movable back and forth between a front position and a rear position in the housing;

a hammering member disposed movable back and forth inside the tool holder;

an intermediate shaft disposed parallel to the tool holder inside the housing, a rotation of the motor being transmitted to the intermediate shaft to cause rotation of the intermediate shaft;

a gear disposed on the intermediate shaft, the gear selectively transmitting the rotation of the intermediate shaft to the tool holder to cause rotation of the tool holder; and a conversion member disposed on the intermediate shaft, the conversion member converting the rotation of the intermediate shaft to a reciprocation of the hammering member, wherein:

the gear is configured to be switched to a first state where the rotation of the intermediate shaft is transmitted to the tool holder and a second state where the rotation of the intermediate shaft is not transmitted to the tool holder, and a mode switching member is configured to perform a switching operation of the gear between the first state and the second state from an outside of the housing;

switching of the gear by the mode switching member between the first state and the second state provides at least two operation modes of (1) a hammer drill mode where the gear integrally rotates with the intermediate shaft to generate the rotation of the tool holder and the reciprocation of the hammering member and (2) a hammer mode where the gear is separated from the rotation of the intermediate shaft to generate only the reciprocation of the hammering member; and the mode switching member and the tool holder are configured such that, only when the hammer mode and hammer drill mode are alternatively selected, can the tool bit be pushed into a workpiece until the tool bit forces the tool holder such that the entirety of the tool holder is in the rear position.

18. A hammer drill comprising:

a housing configured to house a motor;

a tool holder configured to hold a tool bit, the tool holder being disposed in the housing and configured such that an entirety of the tool holder is movable back and forth between a front position and a rear position in the housing;

a hammering member disposed movable back and forth inside the tool holder;

an intermediate shaft disposed parallel to the tool holder inside the housing, a rotation of the motor being transmitted to the intermediate shaft to cause rotation of the intermediate shaft;

a gear disposed on the intermediate shaft, the gear selectively transmitting the rotation of the intermediate shaft to the tool holder to cause rotation of the tool holder; and a conversion member disposed on the intermediate shaft, the conversion member selectively converting the rotation of the intermediate shaft to a reciprocation of the hammering member, wherein:

the gear is configured to be switched to a first state where the rotation of the intermediate shaft is transmitted to the tool holder and a second state where the rotation of the intermediate shaft is not transmitted to the tool holder;

the conversion member and the intermediate shaft are configured such that the conversion member and the intermediate shaft have an engaged position in which the rotation of the intermediate shaft is converted to the reciprocation of the hammering member and an unengaged position in which the rotation of the intermediate shaft does not convert to the reciprocation of the hammering member; and the gear, the conversion member and the tool holder are configured such that the tool holder cannot be in the rear position when the gear is in the first state and the conversion member and the intermediate shaft are in the unengaged position.

19. The hammer drill according to claim 18, further comprising a mode switching mechanism that has a position in which the conversion member and the intermediate shaft are maintained in the unengaged position by preventing relative axial movement between the conversion member and the intermediate shaft while the gear is in the first state.

20. The hammer drill according to claim 19, wherein the intermediate shaft and the conversion member are configured such that;

the intermediate shaft and the conversion member are maintained in the engaged position regardless of a quantity of a press load applied to the tool holder.

* * * * *